US011307513B2

(12) United States Patent
Okubo

(10) Patent No.: US 11,307,513 B2
(45) Date of Patent: Apr. 19, 2022

(54) IMAGE FORMING APPARATUS

(71) Applicant: KYOCERA Document Solutions Inc., Osaka (JP)

(72) Inventor: Takahiro Okubo, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/193,719

(22) Filed: Mar. 5, 2021

(65) Prior Publication Data

US 2021/0286288 A1 Sep. 16, 2021

(30) Foreign Application Priority Data

Mar. 11, 2020 (JP) ..... JP2020-042325

(51) Int. Cl.
*G03G 15/08* (2006.01)

(52) U.S. Cl.
CPC ..... *G03G 15/0856* (2013.01)

(58) Field of Classification Search
CPC ..... G03G 15/086; G03G 15/0848; G03G 15/0849; G03G 15/0851; G03G 15/0853; G03G 15/0855; G03G 15/0856; G03G 15/0862; G03G 2215/0888; G03G 2215/0891; G03G 2215/0894
See application file for complete search history.

(56) References Cited

U.S. PATENT DOCUMENTS

2009/0214231 A1* 8/2009 Nagai ..... G03G 15/0893 399/27
2013/0004187 A1* 1/2013 Watanabe ..... G03G 15/0862 399/29
2014/0045114 A1* 2/2014 Mizobe ..... G03G 9/0819 430/110.2

FOREIGN PATENT DOCUMENTS

JP 2018-81206 A 5/2018

* cited by examiner

*Primary Examiner* — Thomas S Giampaolo, II
(74) *Attorney, Agent, or Firm* — Stein IP, LLC

(57) ABSTRACT

An image forming apparatus includes an image forming unit, a toner detection sensor, a storage unit, and a control unit. The image forming unit includes an image carrier, a charging device, an exposure device, and a developing device. The toner detection sensor detects toner in the developing device. The control unit predicts transition of the toner deterioration degree in the developing device using the toner consumption amount and the cumulative operating time stored in the storage unit, and a predetermined toner deterioration model. The control unit is capable of measuring the toner deterioration degree based on amplitude of an output value of the toner detection sensor, and corrects the toner deterioration model, if the measured value of the toner deterioration degree is apart from the predicted value of the toner deterioration degree by a predetermined value or more.

9 Claims, 7 Drawing Sheets

IMAGE FORMING APPARATUS

INCORPORATION BY REFERENCE

This application is based upon and claims the benefit of priority from the corresponding Japanese Patent Application No. 2020-42325 filed Mar. 11, 2020, the entire contents of which are hereby incorporated by reference.

BACKGROUND

The present disclosure relates to an image forming apparatus such as a copier, a printer, or a facsimile machine, equipped with a developing device. In particular, the present disclosure relates to a method for predicting deterioration of toner in the developing device.

Conventionally, in a development method of an image forming apparatus using an electrophotographic process, powder developer is mainly used. Further, in a general process, an electrostatic latent image, which is formed on an image carrier such as a photosensitive drum, is visualized by the developer, the visualized image (toner image) is transferred onto a recording medium, and then a fixing process is performed.

Developing devices are classified into two types; one uses two-component developer containing toner and magnetic carrier, which is a two-component development method, and the other uses single component developer containing only non-magnetic or magnetic toner, which is a single component development method. In these developing devices, the developer is deteriorated with influence of the number of printed sheets, changes in environment, printing conditions, a coverage rate, or the like. As a result, there is a problem that a malfunction occurs, such as a decrease or increase in image density, image fogging, or toner scattering.

It is known that toner consumption amount in the developing device changes due to a change in a developer state such as a lot difference (production date difference), retention period, or preservation conditions of the developer. However, the toner consumption amount may vary largely in an image forming apparatus that has no function of detecting a deterioration state of toner so as to control in accordance with the deterioration state. In order to ensure the printable number of sheets for a toner container that contains replenishment toner, regardless of the variation in toner consumption amount, it is necessary to excessively supply toner into the toner container. As a result, there is a problem that the toner container becomes large or running cost is increased.

There is known an image forming apparatus, which includes, in order to determine deterioration of developer, a photosensitive drum for carrying an electrostatic latent image, a developing device that stores developer containing mixed toner and carrier, and applies the toner of the developer to the electrostatic latent image on the photosensitive drum, so as to develop the electrostatic latent image, a toner replenishment unit for replenishing toner to the developing device, and a toner concentration sensor for detecting toner concentration of the developer in the developing device. In this image forming apparatus, a deterioration degree of the carrier is determined on the basis of relaxation time, which is time needed for convergence of an output of the toner concentration sensor to a value within a certain range after a ripple appears on the output of the toner replenishment unit.

SUMMARY

An image forming apparatus according to one aspect of the present disclosure includes an image forming unit, a toner detection sensor, a storage unit, and a control unit. The image forming unit includes an image carrier having a surface on which a photosensitive layer is formed, a charging device for charging the image carrier, an exposure device for exposing the image carrier charged by the charging device so that an electrostatic latent image is formed, and a developing device having a developer carrier disposed to face the image carrier so as to carry developer containing toner, and causes the toner to adhere to the electrostatic latent image formed on the image carrier so that a toner image is formed. The toner detection sensor detects the toner inside the developing device. The storage unit stores toner consumption amount in the developing device and cumulative operating time of the developing device. The control unit predicts transition of toner deterioration degree in the developing device, using the toner consumption amount and the cumulative operating time stored in the storage unit, and using a predetermined toner deterioration model. The control unit is capable of measuring the toner deterioration degree on the basis of amplitude of an output value of the toner detection sensor, and corrects the toner deterioration model if a measured value of the toner deterioration degree is apart from a predicted value of the toner deterioration degree by a predetermined value or more.

Other objects of the present disclosure and specific advantages obtained by the present disclosure will become more apparent from the description of the embodiment given below.

DETAILED DESCRIPTION

Figure 1:
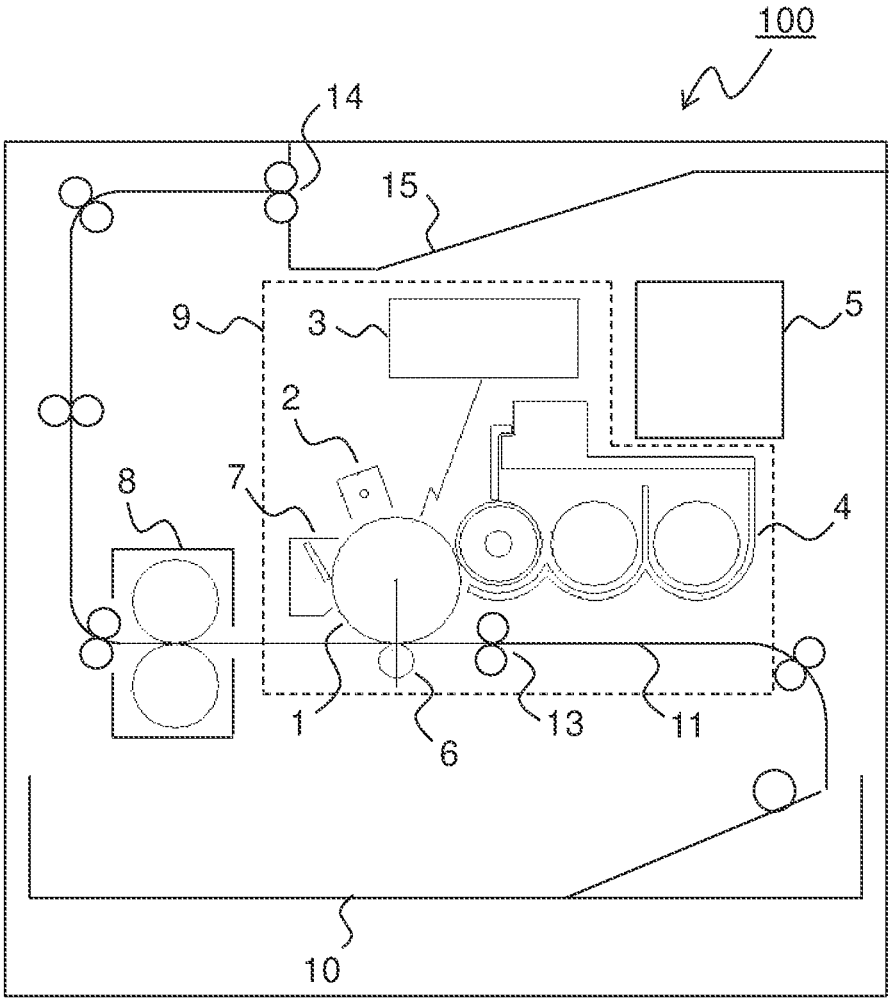
FIG. 1 is a schematic cross-sectional view of an image forming apparatus according to an embodiment of the present disclosure.

Hereinafter, an embodiment of the present disclosure is described with reference to the drawings. FIG. 1 is a schematic cross-sectional view of an image forming apparatus 100 including a developing device 4 according to the embodiment of the present disclosure. In the image forming apparatus (such as a monochrome printer) 100, when a printing operation is performed, an image forming unit 9 in the image forming apparatus 100 forms an electrostatic latent image based on document image data sent from a host device (not shown) such as a personal computer (hereinafter referred to as a computer), and the developing device 4 causes toner to adhere to the electrostatic latent image so that a toner image is formed. The toner is supplied to the developing device 4 from a toner container 5. In the image forming apparatus 100, a photosensitive drum 1 is rotated in a clockwise direction in FIG. 1 while an image forming process is performed on the photosensitive drum 1.

In the image forming unit 9, there are disposed a charging device 2, an exposure device 3, the developing device 4, a transfer roller 6, a cleaning device 7, and a charge elimination device (not shown), along the rotation direction of the photosensitive drum 1 (the clockwise direction). The photosensitive drum 1 is constituted of a photosensitive layer formed on an aluminum drum, for example, and the charging device 2 uniformly charges the surface thereof. Then, the surface receives a light beam from the exposure device 3 described later so as to form an electrostatic latent image having attenuated charge. Further, the photosensitive layer described above is preferably made of, for example, amorphous silicon (a-Si) or the like having good durability, although this is not a limitation.

The charging device 2 uniformly charges the surface of the photosensitive drum 1. As for the charging device 2, for example, a corona discharge device is used, in which a high voltage is applied to an electrode such as a thin wire so that discharge occurs. Note that instead of the corona discharge device, it is possible to use a contact type charging device, which applies a voltage in a state where a charging member such as a charging roller is contacted with the surface of the photosensitive drum 1. The exposure device 3 emits a light beam (such as a laser beam) to the photosensitive drum 1 on the basis of image data, so as to form an electrostatic latent image on the surface of the photosensitive drum 1.

The developing device 4 causes the toner to adhere to the electrostatic latent image on the photosensitive drum 1 so as to form the toner image. Note that in this embodiment, the developing device 4 contains magnetic single component developer (hereinafter referred to as toner) composed of magnetic toner. Further, details of the developing device 4 will be described later. The cleaning device 7 includes a cleaning roller, a cleaning blade, or the like that contacts linearly with the photosensitive drum 1 in a longitudinal direction (direction perpendicular to the paper of FIG. 1), and removes the toner remaining on the surface of the photosensitive drum 1 after the toner image is moved (transferred) to a paper sheet.

Toward the photosensitive drum 1 on which the toner image is formed as described above, the paper sheet is conveyed from a sheet storage unit 10 via a sheet conveying path 11 and a registration roller pair 13 to the image forming unit 9 at a predetermined timing. The transfer roller 6 moves (transfers) the toner image formed on the surface of the photosensitive drum 1 to the paper sheet that is being conveyed in the sheet conveying path 11, without disturbance. After that, as a preparation for anew formation of an electrostatic latent image that is performed successively, the cleaning device 7 removes residual toner on the surface of the photosensitive drum 1, and the charge elimination device eliminates residual charge.

The paper sheet with the transferred toner image is separated from the photosensitive drum 1 and is conveyed to a fixing device 8, in which the toner image is fixed to the paper sheet by heat and pressure. The paper sheet after passing through the fixing device 8 passes through a discharge roller pair 14 and is discharged to a paper sheet discharge unit 15.

Figure 2A:
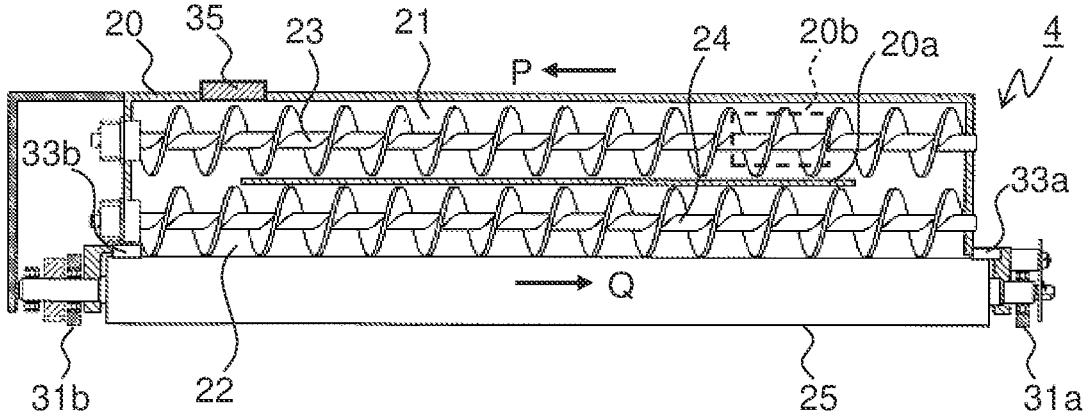
FIG. 2A is a plan view of a developing device mounted in the image forming apparatus of this embodiment.
Figure 2B:
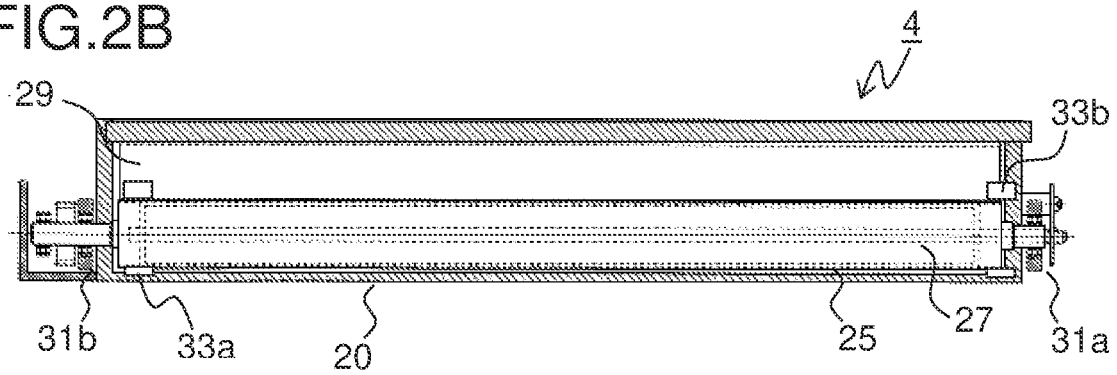
FIG. 2B is a front view of the developing device mounted in the image forming apparatus of this embodiment.
Figure 3:
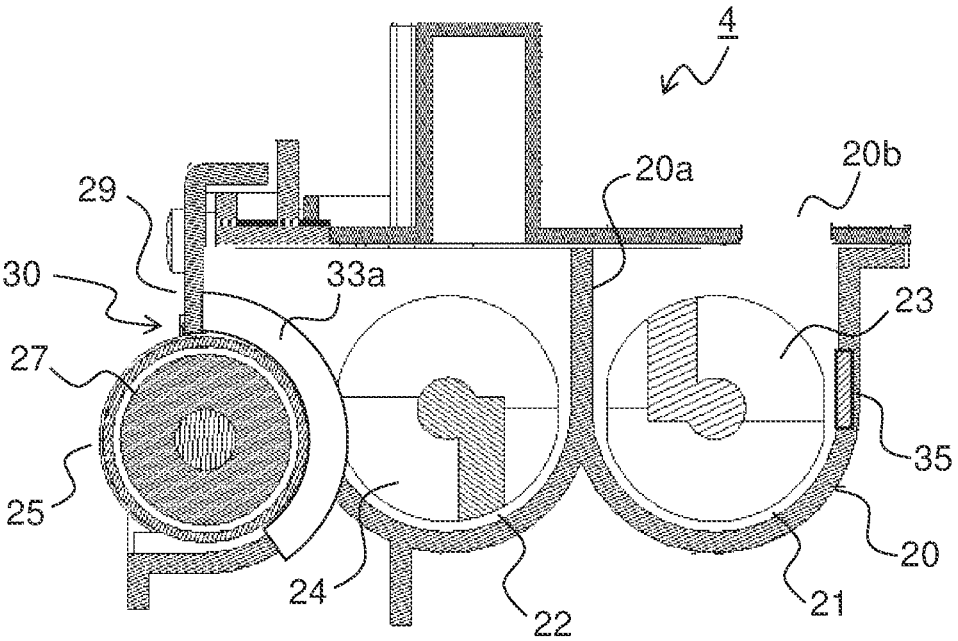
FIG. 3 is a cross-sectional side view of the developing device mounted in the image forming apparatus of this embodiment.

FIGS. 2A and 2B are a plan view and a front view of the developing device 4 mounted in the image forming apparatus 100 of this embodiment, and FIG. 3 is a cross-sectional side view of the developing device 4. Note that FIG. 2A illustrates a state where a top cover is removed so that the inside can be seen, for convenience sake. As illustrated in FIGS. 2A, 2B, and FIG. 3, the inside of a developing container 20 is divided into a first retention chamber 21 and a second retention chamber 22 by a partition wall 20*a* formed integrally to the developing container 20. The first retention chamber 21 is equipped with a first stirring screw 23, and the second retention chamber 22 is equipped with a second stirring screw 24.

The first stirring screw 23 and the second stirring screw 24 each have a structure including a spiral screw formed around a spindle (rotation shaft), and they are supported rotatably in parallel to each other by the developing container 20. Note that, as illustrated in FIG. 2A, the partition wall 20*a* does not exist on both sides in a longitudinal direction of the developing container 20, i.e. in an axis direction of the first stirring screw 23 and the second stirring screw 24, so that the toner can move between the first stirring screw 23 and the second stirring screw 24. In this way, the first stirring screw 23 stirs the toner in the first retention chamber 21 while conveying the same in a direction of an arrow P to the second retention chamber 22, and the second stirring screw 24 stirs the toner that has been conveyed to the second retention chamber 22 while conveying the toner in a direction of an arrow Q so as to supply the same to a developing roller 25.

The developing roller 25 rotates in response to rotation of the photosensitive drum 1 (see FIG. 1) so as to supply toner to the photosensitive layer of the photosensitive drum 1. Inside the developing roller 25, there is secured a fixed magnetic member 27 constituted of a permanent magnet having a plurality of magnetic poles. Magnetic force of the fixed magnetic member 27 causes the surface of the developing roller 25 to attract (carry) the toner so as to form a magnetic brush. The developing roller 25 is supported rotatably by the developing container 20 in parallel to the first stirring screw 23 and the second stirring screw 24. The developing roller 25 is applied with a developing voltage, in which an AC voltage Vac is superimposed on a DC voltage Vdc, from a developing voltage power supply 53 (see FIG. 4).

A regulating blade 29 has a width in the longitudinal direction (a left and right direction in FIGS. 2A and 2B) that is larger than a maximum developing width, and is disposed apart from the developing roller 25 with a predetermined space, so as to form a regulating portion 30 that regulates amount of toner (layer thickness of toner) supplied to the photosensitive drum 1. As a material of the regulating blade 29, magnetic stainless steel (SUS) or the like is used.

DS sleeves 31*a* and 31*b* are engaged with the outer surface of the rotation shaft of the developing roller 25 in a rotatable manner. The DS sleeves 31*a* and 31*b* contact with both ends in the axis direction of an outer circumference surface of the photosensitive drum 1, so as to strictly regulate distance between the developing roller 25 and the photosensitive drum 1. Bearings are embedded in the DS sleeves 31*a* and 31*b*, and hence abrasion of the drum surface can be prevented when rotating following the photosensitive drum 1. In addition, on both end portions in the axis direction of the developing roller 25, there are disposed magnetic seal members 33*a* and 33*b* for preventing leakage of toner through a gap between the developing container 20 and the developing roller 25.

An inner wall surface of the first retention chamber 21 is equipped with a toner level sensor 35 disposed to face the conveying stirring screw 23. The toner level sensor 35 is a sensor for detecting toner level (toner volume) in the developing container 20, and for example, a magnetic permeability sensor is used, which detects magnetic permeability of developer in the developing container 20. When the toner level sensor 35 detects magnetic permeability of the developer, a voltage value corresponding to the detection result is output to a control unit 90 (see FIG. 4) that will be described later, and the toner level is determined from the output value of the toner level sensor 35 by the control unit 90. In accordance with the determined toner level, the control unit 90 sends a control signal to a toner replenishment motor 37 (see FIG. 4), and a predetermined amount of toner is replenished from the toner container 5 (see FIG. 1) to the first retention chamber 21 via a developer replenishment port 20*b*. Note that it is also possible to use a piezoelectric sensor instead of the magnetic permeability sensor as the toner level sensor 35.

Figure 4:
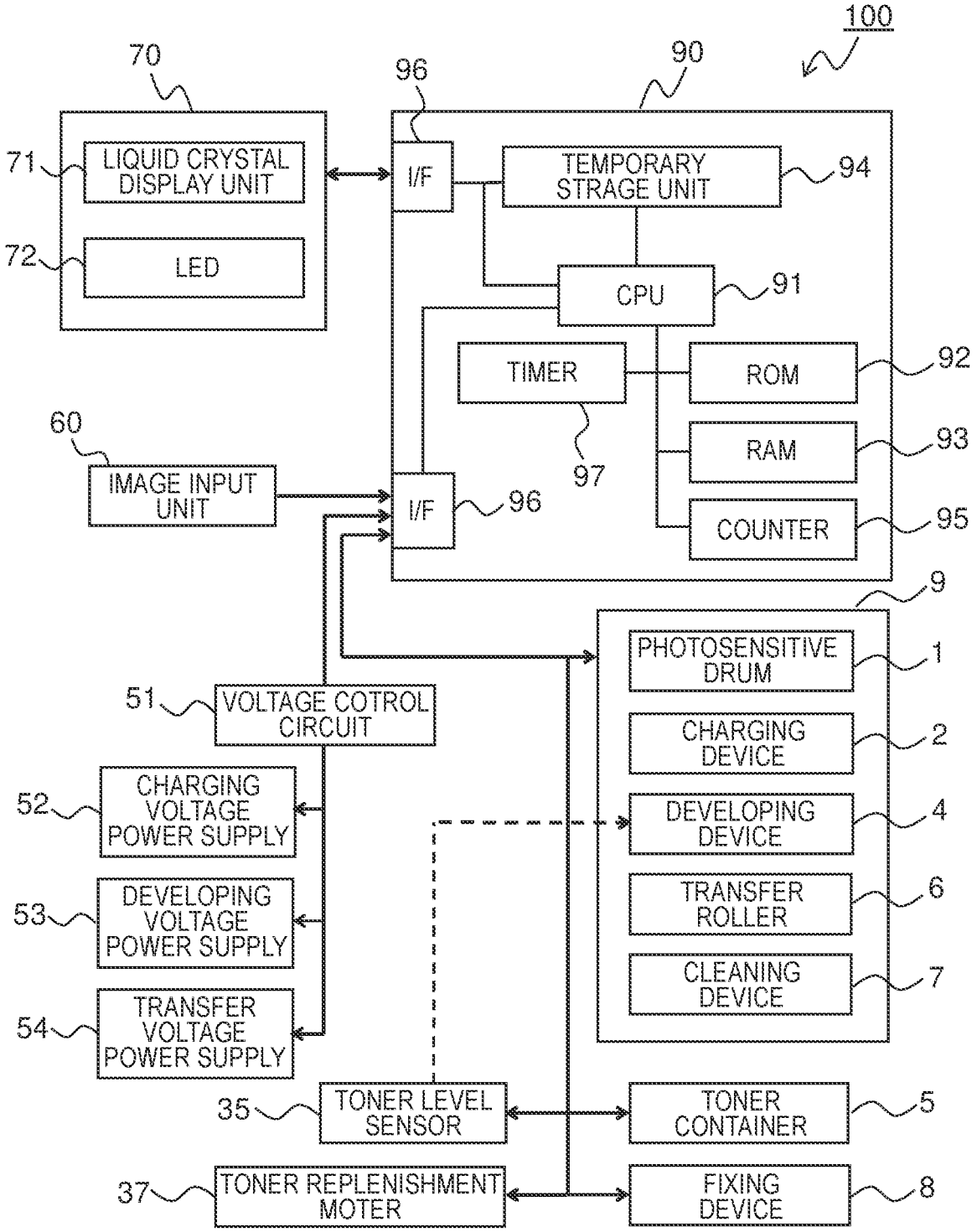
FIG. 4 is a block diagram illustrating an example of control paths used in the image forming apparatus.

FIG. 4 is a block diagram illustrating an example of control paths used in the image forming apparatus 100 of this embodiment. Note that various controls are performed for individual portions of the apparatus when using the image forming apparatus 100, and hence control paths of the entire image forming apparatus 100 are complicated. Therefore, among the control paths, sections needed for implementing the present disclosure are mainly described.

A voltage control circuit 51 is connected to a charging voltage power supply 52, the developing voltage power supply 53, and a transfer voltage power supply 54, so as to control the individual power supplies to operate in accordance with output signals from the control unit 90. On the basis of control signals from the voltage control circuit 51, the charging voltage power supply 52 applies a predetermined voltage to the wire in the charging device 2, the developing voltage power supply 53 applies a predetermined voltage to the developing roller 25 in the developing device 4, and the transfer voltage power supply 54 applies a predetermined voltage to the transfer roller 6.

An image input unit 60 is a receiving unit that receives image data sent from the computer or the like to the image forming apparatus 100. The image signal input from the image input unit 60 is converted into a digital signal, and then is sent to a temporary storage unit 94.

An operating unit 70 is equipped with a liquid crystal display unit 71, and an LED 72 that indicates various states, and it indicates a status of the image forming apparatus 100 or displays an image formation situation and the number of printed copies. Various settings of the image forming apparatus 100 are performed in a printer driver on the computer.

The control unit 90 includes at least a central processing unit (CPU) 91, a read only memory (ROM) 92 that is a storage unit used for only reading, a random access memory (RAM) 93 that is a readable and writable storage unit, the temporary storage unit 94 that temporarily stores image data or the like, a counter 95, a timer 97, a plurality of (e.g. two) interfaces (I/Fs) 96 for sending the control signals to individual devices in the image forming apparatus 100 and receiving input signals from the operating unit 70.

The ROM 92 stores a programs for controlling the image forming apparatus 100 and data that is not changed during use of the image forming apparatus 100, such as values necessary for the control. The RAM 93 stores necessary data generated during the control of the image forming apparatus 100, data temporarily needed for controlling the image forming apparatus 100, and the like. In addition, the RAM 93 (or the ROM 92) also stores a table showing relationship between cumulative operating time of the developing device 4 measured by the timer 97 and toner deterioration degree (see FIG. 5), and a table showing relationship between amplitude of sensor output value of the toner level sensor 35 and the toner deterioration degree (see FIG. 7).

The temporary storage unit 94 temporarily stores an image signal that is a digital signal converted after being input from the image input unit 60 that receives the image data sent from the computer or the like. The counter 95 accumulates and counts the number of printed sheets. The timer 97 measures the cumulative operating time after start of use of the developing device 4.

In addition, the control unit 90 sends control signals to individual portions and devices of the image forming apparatus 100 from the CPU 91 via the I/F 96. In addition, the individual portions and devices send signals indicating their states and input signals to the CPU 91 via the I/F 96. The individual portions and devices controlled by the control unit 90 include, for example, the fixing device 8, the image forming unit 9, the voltage control circuit 51, the image input unit 60, the operating unit 70, and the like.

Hereinafter, a method for estimating the toner deterioration degree, which is the characterized part of the present disclosure, is described in detail. The image forming apparatus 100 of the present disclosure measures the toner deterioration degree in the developing device 4 on the basis of the amplitude of the sensor output value of the toner level sensor 35, and predicts future transition of the toner deterioration degree on the basis of a toner deterioration model stored beforehand in the RAM 93 (or the ROM 92). The control unit 90 corrects the toner deterioration model by using the estimated result of the toner deterioration degree based on the amplitude of the output value of the toner level sensor 35.

(Estimation of Toner Deterioration Degree Based on Toner Deterioration Model)

Figure 5:
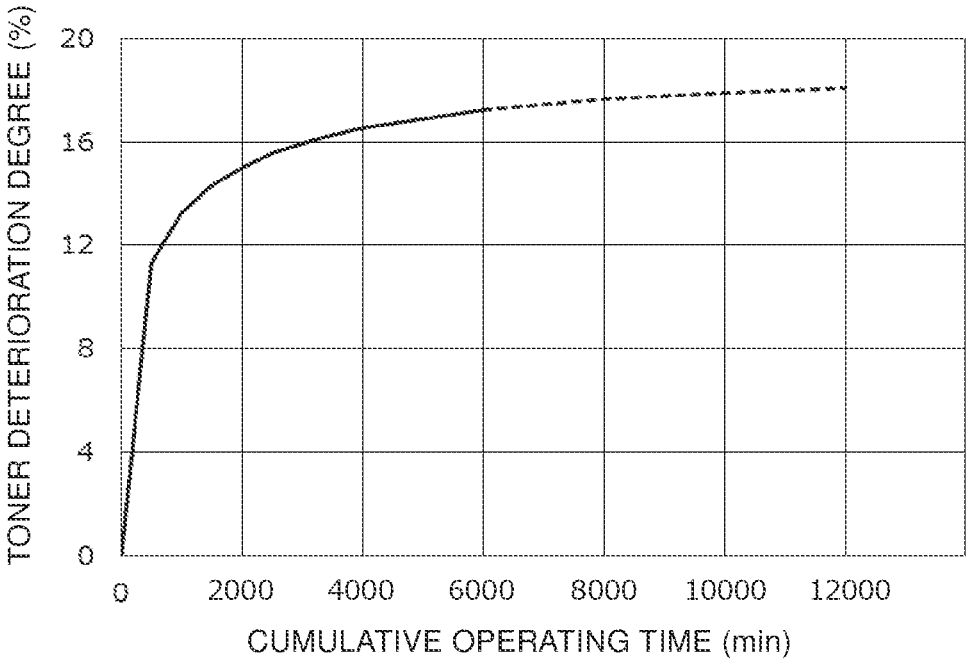
FIG. 5 is a graph illustrating relationship between cumulative operating time of the developing device and toner deterioration degree.

FIG. 5 is a graph illustrating relationship between the cumulative operating time (min) of the developing device 4 and the toner deterioration degree (%). As illustrated in FIG. 5, deterioration of toner proceeds rapidly at initial stage of operation start of the developing device 4 (0 to 1000 min), and proceeds slowly after that. The toner deterioration degree C. of FIG. 5 is expressed by the prediction equation (1) below:

$$C=A\times V/Q(1-\exp(-(Q/V)\times T)) \quad (1),$$

where A represents deterioration coefficient, V represents toner amount in the developing device, Q represents toner consumption amount, and T represents cumulative operating time of the developing device.

It is possible to predict transition of the toner deterioration degree by tracking the toner consumption amount Q and the cumulative operating time T of the developing device 4, using FIG. 5 and the prediction equation (1). Note that in this specification, the toner deterioration degree is defined as degree of freedom (%) of toner external additive from toner particles. The state where the toner external additive is not free at all is 0%, while the state where the toner external additive is completely free is 100%.

(Measurement of Toner Deterioration Degree by Toner Level Sensor)

Figure 6:
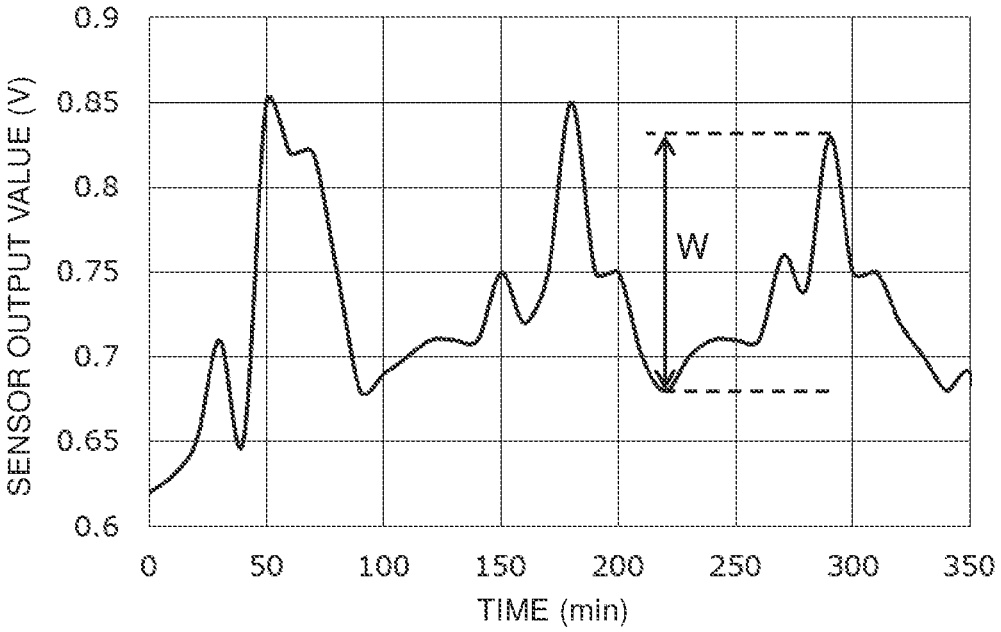
FIG. 6 is a graph illustrating relationship between detection time and sensor output value of a toner level sensor.

FIG. 6 is a graph illustrating relationship between detection time (min) and sensor output value (V) of the toner level sensor 35. The toner just after filling in the developing device 4 (initial toner) has good fluidity so that toner retention does not occur on the upstream side of the toner level sensor 35. Therefore, the sensor output value is stable. However, when toner deterioration occurs due to long operation of the developing device 4, the fluidity of toner becomes poor. As a result, toner retention tends to occur on the upstream side of the toner level sensor 35, and the amplitude W (V) of the sensor output value increases. Using this phenomenon, the toner deterioration degree can be measured from the amplitude of the sensor output value.

Figure 7:
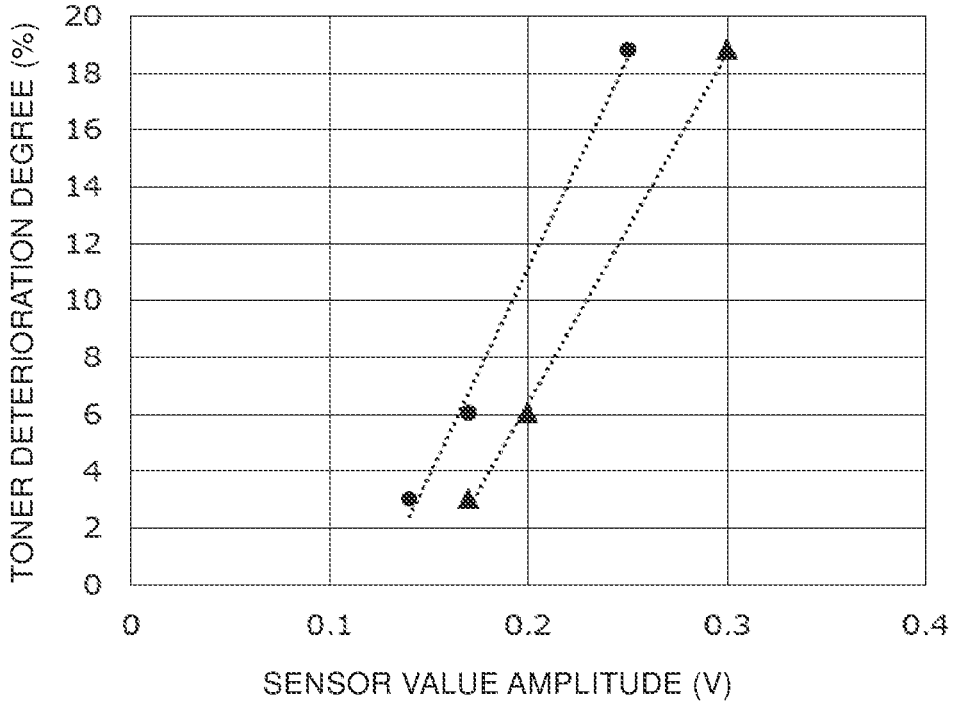
FIG. 7 is a graph illustrating relationship between amplitude of the sensor output value and the toner deterioration degree when a rotation speed (linear speed) of a first stirring screw and a second stirring screw is changed.

FIG. 7 is a graph illustrating relationship between the amplitude (V) of the sensor output value and the toner deterioration degree (%) when a rotation speed (linear speed) of the first stirring screw 23 and the second stirring screw 24 is changed. As illustrated in FIG. 7, there is certain correlation between the amplitude of the sensor output value and the toner deterioration degree, and it is understood that the toner deterioration degree can be measured from the amplitude of the sensor output value. In addition, as illustrated in FIG. 7, the toner deterioration degrees are determined from the amplitudes of the sensor output value when the linear speed of the first stirring screw 23 and the second stirring screw 24 is changed in two steps of 192 rpm (data group of ▲ in FIG. 7) and 384 rpm (data group of ● in FIG. 7), and an average value of the determined toner deterioration degrees is used so that the toner deterioration degree can be measured more accurately.

(Correction of Toner Deterioration Model)

If the measured value of the toner deterioration degree measured on the basis of FIGS. 6 and 7 is largely apart from the predicted value of the toner deterioration degree estimated on the basis of FIG. 5 and the prediction equation (1), the toner deterioration model is corrected. Specifically, the deterioration coefficient A in the prediction equation (1) is corrected. In this way, the toner deterioration model can be corrected to be suitable for operating environment of the image forming apparatus 100 or state of toner, and hence transition of the toner deterioration degree can be predicted more accurately.

In addition, on the basis of the future transition of the toner deterioration degree predicted based on FIG. 5 and the prediction equation (1), it is possible to determine a timing at which the toner deterioration degree should be measured next time and after. For instance, at initial stage of using the developing device 4, measured data of the toner deterioration degree are not accumulated, and therefore the toner deterioration degree is measured with the toner level sensor 35 every time w % ben reaching a certain operating time. In addition, after obtaining measured data of the toner deterioration degree a plurality of times, the toner deterioration degree can be estimated with a certain level of accuracy, and hence it is possible to increase the time interval for measuring the toner deterioration degree.

Furthermore, it may be possible to set a threshold value of the toner deterioration degree in advance, and to perform a recovery operation of the toner deterioration degree when the toner deterioration degree exceeds the threshold value. As the recovery operation, there are forced discharge control of toner, change of target value of the toner amount in the developing device 4, change of development conditions for the developing device 4, and the like. The change of the development conditions is performed basically by changing the DC component Vdc of the developing voltage, but it is also possible to change a peak to peak value, a duty ratio, or a frequency of the AC component Vac of the developing voltage.

Figure 8:
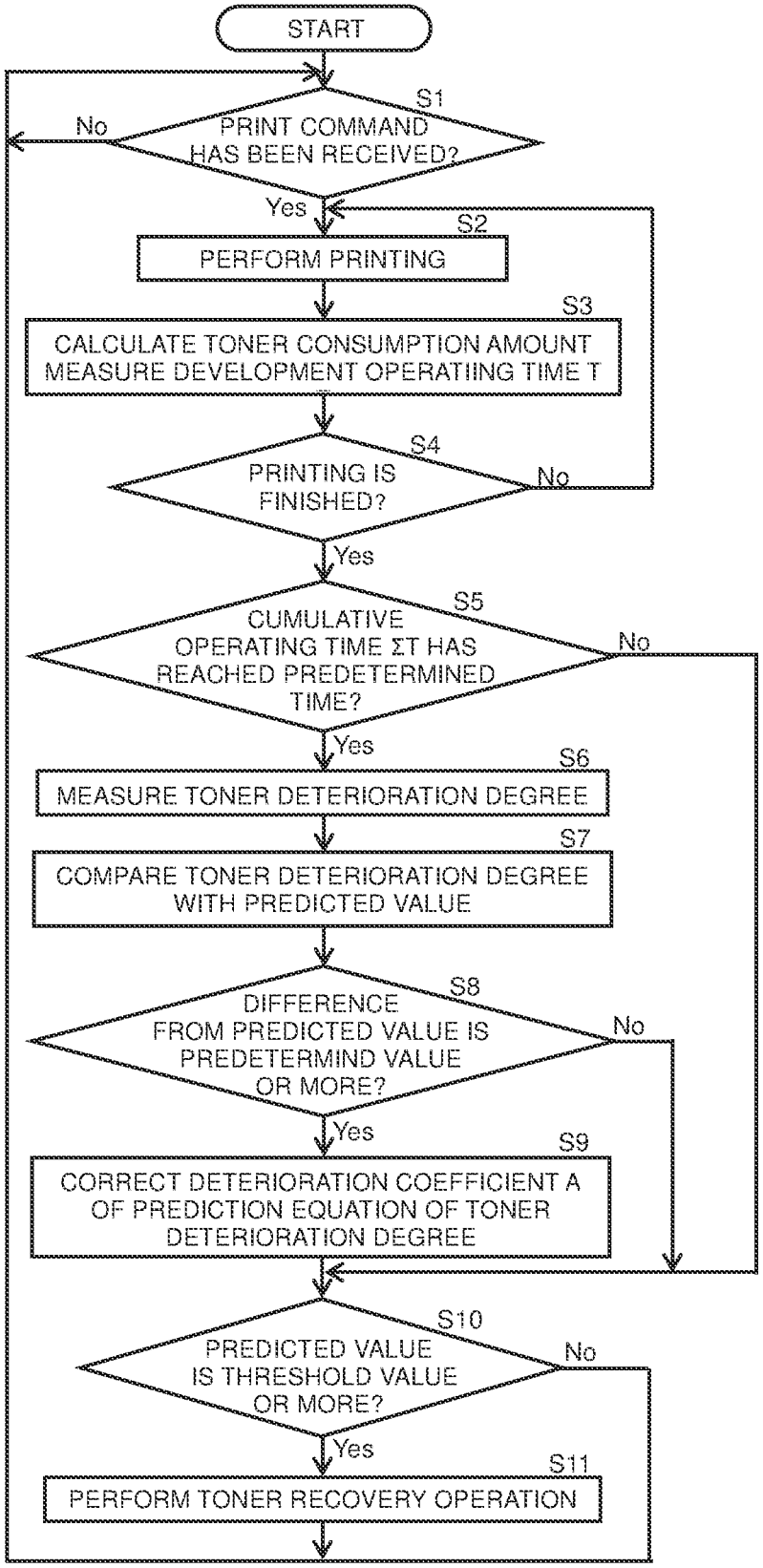
FIG. 8 is a flowchart illustrating a prediction control example of the toner deterioration degree in the image forming apparatus of this embodiment.

FIG. 8 is a flowchart illustrating a prediction control example of the toner deterioration degree in the image forming apparatus 100 of this embodiment. A prediction procedure of the toner deterioration degree is described below along the steps of FIG. 8, with reference to FIGS. 1 to 7 as necessary.

First, the control unit 90 determines whether or not a print command has been received (Step S1). If the print command has been received (Yes in Step S1), printing is performed by normal image forming operation (Step S2). Then, in parallel with the image forming operation, the toner consumption amount is calculated on the basis of the image data input to the image input unit 60, and operating time of the developing device 4 (development operating time T) is measured by the timer 97 (Step S3). The measured toner consumption amount and development operating time T are stored in the RAM 93.

Next, the control unit 90 determines whether or not the printing is finished (Step S4). If the printing is not finished (No in Step S4), the process flow returns to Step S2, so as to continue to execute printing, calculate the toner consumption amount, and measure the development operating time T. If the printing is finished (Yes in Step S4), the control unit 90 determines whether or not the cumulative operating time ΣT of the development operating time T has reached a predetermined time (Step S5).

If the cumulative operating time ΣT has reached the predetermined time (Yes in Step S5), the toner deterioration degree is measured (Step S6). Specifically, the toner deterioration degree is measured using the relationship of FIG. 7, on the basis of the amplitude W of the output value of the toner level sensor 35.

Next, the control unit 90 compares the toner deterioration degree measured in Step S6 with the predicted value estimated based on the toner deterioration model (Step S7). The predicted value of the toner deterioration degree is determined using temporal transition data of the toner deterioration degree obtained by past measurement of the toner deterioration degree (see FIG. 5). In addition, before the measured value of the toner deterioration degree is obtained a plurality of times, the predicted value of the toner deterioration degree is calculated using the prediction equation (1) of the toner deterioration degree stored beforehand in the ROM 92 (or the RAM 93).

The control unit 90 determines whether or not the toner deterioration degree is apart from the predicted value by a predetermined value or more (Step S8). If the toner deterioration degree is apart from the predicted value by a predetermined value or more (Yes in Step S8), the control unit 90 corrects the deterioration coefficient A of the prediction equation (1) of the toner deterioration degree (Step S9). If a difference between the toner deterioration degree and the predicted value is less than the predetermined value (No in Step S8), the process flow proceeds to the next step without correcting the deterioration coefficient A. Further, in Step S5, if the cumulative operating time ΣT of the developing device 4 has not reached the predetermined time (No in Step S5), the process flow proceeds to the next step without measuring the toner deterioration degree and comparing with the predicted value.

Next, the control unit 90 determines whether or not the predicted value of the toner deterioration degree is a predetermined threshold value or more (Step S10). If it is the threshold value or more (Yes in Step S10), the control unit 90 determines that deterioration of toner has proceeded and performs the toner recovery operation (Step S11). For instance, the control unit 90 performs a forced discharge operation, in which an electrostatic latent image pattern (solid pattern) is formed on the photosensitive drum 1, and the developing voltage is applied to the developing roller 25, so that the deteriorated toner on the developing roller 25 is moved (forcedly discharged) onto the photosensitive drums 1. In addition, as understood from the prediction equation (1), the toner deterioration degree C. becomes lower as the toner amount V in the developing device 4 becomes less. Therefore, the target value of the toner amount in the developing container 20 is decreased so as to decrease the toner deterioration degree.

In addition, the developing voltage is changed instead of the forced discharge operation or decreasing of the target value of the toner amount, or together with the forced discharge operation or decreasing of the target value of the toner amount. For instance, the DC component Vdc of the developing voltage is increased so that developability is enhanced by decreasing development potential difference VO-Vdc between surface potential VO of the photosensitive drum and the DC component Vdc, and thus decrease in the image density is suppressed. Alternatively, the developability can be enhanced also by increasing the peak to peak value of the AC component Vac of the developing voltage, or by increasing the duty ratio thereof, or by increasing or decreasing the frequency thereof. After that, the process flow returns to Step S1, and a waiting state for the print command is continued.

If the predicted value of the toner deterioration degree is less than the threshold value (No in Step S10), the process flow returns to Step S1 without performing the toner recovery operation, and the waiting state for the print command is continued.

According to the control example of FIG. 8, the toner deterioration degree measured based on the amplitude of the output value of the toner level sensor 35 is compared with the predicted value of the toner deterioration degree estimated based on the toner deterioration model, and the deterioration coefficient A of the prediction equation (1) is corrected if they are apart from each other by a predetermined value or more. In other words, the prediction equation is corrected to be suitable for the measured value of the toner deterioration degree. As a result, prediction accuracy of the transition of the toner deterioration degree is enhanced, and the toner consumption amount can be optimized. Therefore, toner supply amount into the toner container 8 can also be optimized.

In addition, because the toner recovery operation is performed when the toner deterioration degree is a threshold value or more, the toner recovery operation can be performed at an appropriate timing. Therefore, it is possible to suppress an image defect due to deterioration of toner while preventing an increase in toner consumption amount for other than printing due to unnecessary execution of the toner recovery operation.

Note that in the control example of FIG. 8, the toner recovery operation is performed if the predicted value of the toner deterioration degree is a threshold value or more. However, the liquid crystal display unit 71 may display life of the developing device 4 based on the predicted value of the toner deterioration degree. Furthermore, if the toner deterioration degree is not recovered even after the toner recovery operation is performed, it may be possible to perform a display (alert) urging replacement of the developing device 4. In this way, it is avoided to use the developing device 4 for a long period in a state where the toner is deteriorated, and thus occurrence of an image defect or clogging of toner at the regulating portion 30 can be effectively suppressed.

Other than that, the present disclosure is not limited to the embodiment described above, but can be modified variously within the scope of the present disclosure without deviating from the spirit thereof. For instance, in the embodiment described above, the image forming apparatus 100 includes the developing device 4 using magnetic single component developer. However, also in a non-magnetic single component development method using only non-magnetic toner or a two-component development method using two-component developer containing magnetic carrier and toner, fluidity of developer is decreased as deterioration of toner proceeds, and hence the amplitude of the output value of the toner detection sensor is increased. Therefore, the present disclosure can be applied also to an image forming apparatus equipped with the developing device of the non-magnetic single component development method or the two-component development method, in the same manner.

Note that when using the non-magnetic single component developer, it is necessary to use a piezoelectric sensor as the toner level sensor 35 instead of the magnetic permeability sensor. In addition, when using the two-component developer, it is possible to use the magnetic permeability sensor as a toner concentration detection sensor for detecting toner concentration in the two-component developer (a ratio of toner to carrier). In either case, the toner deterioration degree can be measured on the basis of the amplitude of the sensor output value.

In addition, as the image forming apparatus 100, the monochrome printer as illustrated in FIG. 1 is exemplified for description. However, the image forming apparatus 100 is not limited to the monochrome printer, but can be other type of image forming apparatus such as a monochrome or color copier, a color printer, a digital multifunction peripheral, or a facsimile machine. Hereinafter, effects of the present disclosure are described in more detail using Example.

Example

A verification test was performed about the suppressing effect of the toner consumption amount when the prediction control of the toner deterioration degree illustrated in FIG. 8 was carried out, and the image formation conditions were changed based on the prediction result of the toner deterioration degree. Conditions of the test machine were as follows. In the image forming apparatus 100 as illustrated in FIG. 1, the photosensitive drum 1 having the photosensitive layer made of amorphous silicon (a-Si) and a diameter of 30 mm was used, and the potential VO of an unexposed part was 220 to 255 V. In addition, the linear speed of the photosensitive drum 1 was 240.28 mm/sec (printing speed was 40 sheets/min).

In the developing device 4, the developing roller 25 having a blast finish surface and a diameter of 20 mm was used, the linear speed of the developing roller 25 was 384 mm/sec, and the distance between the developing roller 25 and the photosensitive drum 1 was 0.30 mm. The developing roller 25 was applied with the developing voltage, in which the AC voltage Vac having the peak to peak value (Vpp) of 1,325 V, the duty ratio of 64%, and the frequency of 3.1 kHz is superimposed on the DC voltage Vdc of 135 to 170 V.

In addition, the magnetic single component developer containing positively charged toner having an average particle size of 6.8 μm was used, and the magnetic permeability sensor was used as the toner level sensor 35.

The test method was as follows. When performing durable printing of 500,000 sheets, the transition of the toner consumption amount (g/page) per printed sheet was compared between the case where the toner deterioration degree was measured along the steps illustrated in FIG. 8, and the correction of the toner deterioration model was performed based on the measurement results (the present disclosure), and the case where the toner deterioration degree was not measured and the correction of the toner deterioration model was not performed (a comparative example). The result is illustrated in FIG. 9.

Figure 9:
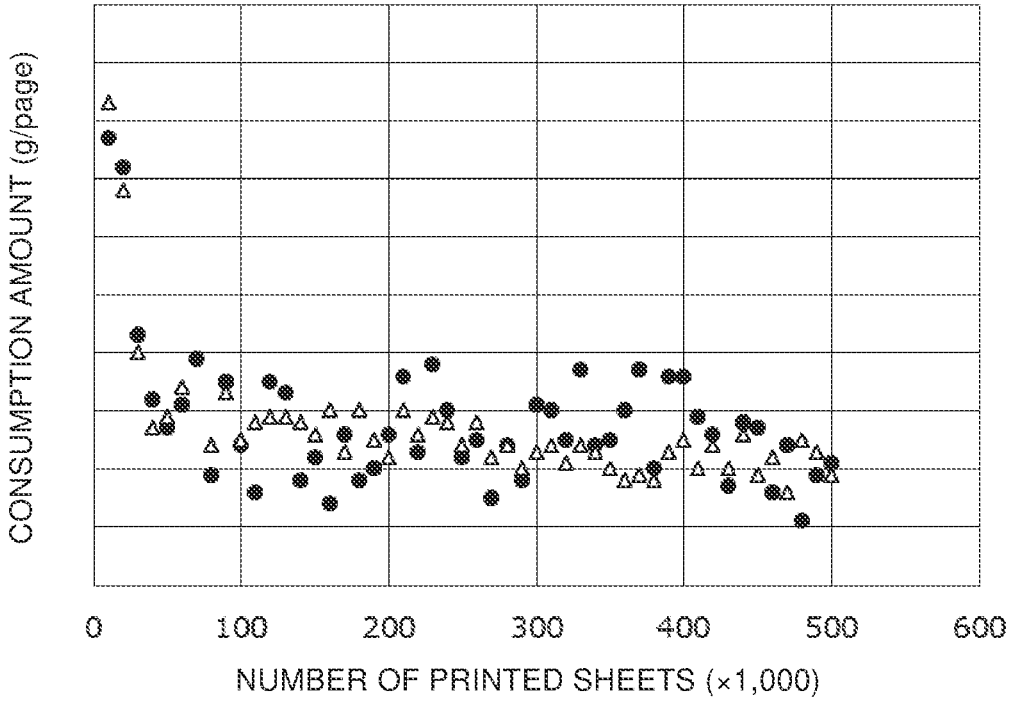
FIG. 9 is a graph illustrating transitions of toner consumption amount in a case where correction of a toner deterioration model is performed on the basis of measurement results of the toner deterioration degree (the present disclosure), and in a case where the correction of the toner deterioration model is not performed (a comparative example), in Example.

As clear from FIG. 9, it was confirmed that in the present disclosure (data group of Δ in the figure) in which the correction of the toner deterioration model was performed based on the measurement results of the toner deterioration degree, variation in the toner consumption amount becomes small because estimation accuracy of the toner deterioration degree is enhanced, compared with the comparative example (data group of ● in the figure).

The present disclosure can be used in an image forming apparatus equipped with a developing device. Using the present disclosure, it is possible to provide an image forming apparatus capable of accurately predicting future transition of deterioration of developer.

What is claimed is:

1. An image forming apparatus comprising:

an image forming unit including an image carrier having a surface on which a photosensitive layer is formed, a charging device for charging the image carrier, an exposure device for exposing the image carrier charged by the charging device so that an electrostatic latent image is formed, and a developing device having a developer carrier disposed to face the image carrier so as to carry developer containing toner, and causes the toner to adhere to the electrostatic latent image formed on the image carrier so that a toner image is formed;

a toner detection sensor for detecting the toner inside the developing device;

a storage unit for storing toner consumption amount in the developing device and cumulative operating time of the developing device; and a control unit arranged to predict transition of toner deterioration degree in the developing device, using the toner consumption amount and the cumulative operating time stored in the storage unit, and using a predetermined toner deterioration model, wherein the control unit is capable of measuring the toner deterioration degree on the basis of amplitude of an output value of the toner detection sensor, and corrects the toner deterioration model if a measured value of the toner deterioration degree is apart from a predicted value of the toner deterioration degree by a predetermined value or more, while not correcting the toner deterioration model if the measured value of the toner deterioration degree is not apart from the predicted value of the toner deterioration degree by the predetermined value or more.

2. The image forming apparatus according to claim 1, wherein the developing device uses magnetic single component developer containing only the toner having magnetic property as the developer, and the toner detection sensor is a toner level sensor for detecting volume of the toner in the developing device.

3. The image forming apparatus according to claim 2, wherein the control unit predicts the transition of the toner deterioration degree using the following prediction equation (1) of the toner deterioration model, and if the measured value of the toner deterioration degree is apart from the predicted value of the toner deterioration degree by a predetermined value or more, the control unit corrects deterioration coefficient A in the prediction equation (1):

$$C=A\times V/Q(1-\exp(-(Q/V)\times T)) \quad (1),$$

where A represents deterioration coefficient, V represents toner amount in the developing device, Q represents toner consumption amount, and T represents cumulative operating time of the developing device.

4. The image forming apparatus according to claim 1, wherein the developing device includes a developing container for storing developer carried by the developer carrier, and a stirring conveying member for stirring and conveying the developer in the developing container, and the control unit determines the measured value by averaging a plurality of toner deterioration degrees measured from amplitudes of output values of the toner detection sensor when linear speed of the stirring conveying member is changed in a plurality of steps.

5. The image forming apparatus according to claim 1, wherein the control unit determines a measurement timing of the toner deterioration degree on the basis of the transition of the toner deterioration degree predicted from the toner deterioration model.

6. The image forming apparatus according to claim 1, wherein the control unit performs a toner recovery operation for recovering the toner deterioration degree if the predicted value of the toner deterioration degree is a predetermined value or more.

7. The image forming apparatus according to claim 6, wherein the control unit performs a forced discharge operation as the toner recovery operation, in which the toner carried by the developer carrier is forcedly discharged onto the image carrier.

8. The image forming apparatus according to claim 6, further comprising a developing voltage power supply for applying the developer carrier with a developing voltage in which an AC voltage is superimposed on a DC voltage, wherein the control unit changes a DC component of the developing voltage or changes at least one of peak to peak value, duty ratio, and frequency of an AC component of the developing voltage, as the toner recovery operation.

9. The image forming apparatus according to claim 1, further comprising a display device capable of displaying a display of life of the developing device predicted based on the toner deterioration degree, or a display urging replacement of the developing device, wherein when the predicted value of the toner deterioration degree is a predetermined value or more, the control unit controls the display device to display at least one of the display of life of the developing device and the display urging replacement of the developing device.

* * * * *